United States Patent [19]

Carver

[11] Patent Number: 4,798,291

[45] Date of Patent: Jan. 17, 1989

[54] DISPLAY CARRIER FOR ARTICLES

[75] Inventor: Robert G. Carver, Ashland, Ohio

[73] Assignee: Coburn, Inc., Ashland, Ohio

[21] Appl. No.: 88,907

[22] Filed: Aug. 24, 1987

[51] Int. Cl.[4] ..... B65D 85/44

[52] U.S. Cl. ..... 206/426; 206/45.14; 206/427; 229/40

[58] Field of Search ..... 206/45.14, 180, 182, 206/186, 193, 197, 426, 427, 429, 434; 229/40

[56] References Cited

U.S. PATENT DOCUMENTS

| | | | |
|---|---|---|---|
| 2,637,476 | 8/1950 | Empkie, Jr. | 224/45 |
| 2,798,655 | 7/1957 | Buttery et al. | 229/40 |
| 2,911,096 | 11/1959 | Andre | 206/434 |
| 3,598,302 | 8/1971 | Nowak | 229/28 |
| 3,790,906 | 12/1973 | Katzenmeyer | 220/113 |
| 3,854,580 | 12/1974 | Hennessey | 206/426 |
| 3,896,927 | 7/1975 | Dutcher | 206/45.14 |
| 3,931,888 | 1/1976 | Fogel | 206/434 |
| 4,037,721 | 7/1977 | Schillinger | 206/434 |
| 4,130,202 | 12/1978 | Champlin et al. | 206/434 |
| 4,149,636 | 4/1979 | Pintsak et al. | 206/434 |
| 4,155,450 | 5/1979 | Schillinger | 206/434 |
| 4,184,626 | 1/1980 | Graser et al. | 229/40 |
| 4,212,391 | 7/1980 | Schillinger | 206/434 |
| 4,278,197 | 7/1981 | Scheinbaum et al. | 229/30 |
| 4,381,057 | 4/1983 | Carver | 206/434 |
| 4,448,308 | 5/1984 | Carver | 206/434 |
| 4,603,779 | 8/1986 | Meyers et al. | 206/426 |
| 4,606,457 | 8/1986 | Pugh | 206/426 |

*Primary Examiner*—David T. Fidei

*Attorney, Agent, or Firm*—Renner, Otto, Boisselle & Sklar

[57] ABSTRACT

A display carrier for articles includes hingedly connected top, bottom and side walls forming a sleeve and a deflectable retainer for releasably engaging an article in the carrier. The deflectable retainer hingedly extends from an edge of the bottom wall and has a fold line defining a distal flap attached to the inside of the bottom wall of the carrier between the center line of the bottom wall and the fold line from which the retainer extends. Two intermediate fold lines give the retainer a quadrilateral cross section and permit the retainer to be deflected toward the bottom wall for engaging or disengaging an article end with the carrier. Articles can be inserted and withdrawn from the carrier by deflecting the retainer without damage to the carrier. A second retainer for articles having an open or chimed end extends from an edge of the top wall of the carrier. The second retainer includes a retaining portion having a curved edge for engaging the inside surface of an article having a chimed or open end. The second retainer includes an attaching portion, separated from the retaining portion by a lateral cut, that includes fold lines defining an adhering flap. The adhering flap is attached to the inside of the top surface to hold the single ply retaining portion in an operative position for securing an end of an article inserted into the carrier. The invention also includes blanks from which the novel carriers may be assembled.

27 Claims, 4 Drawing Sheets

DISPLAY CARRIER FOR ARTICLES

BACKGROUND OF THE INVENTION

The present invention relates to carriers for articles, such as tumblers, goblets, and the like, that are used to pack the articles for shipping and to display them for sale. These carriers do not fully enclose the articles so that prospective purchasers can be attracted by their appearance and can inspect the articles before purchasing them.

Numerous display carrier designs are known. Typically, the carriers are formed of a naturally resilient material such as heavy paperboard or cardboard. Known carriers include one or more latch mechanisms for engaging an article inserted in a carrier. For an article, such as a can or a tumbler, having an open or chimed end, latches may consist of a resilient tab formed from multiple thicknesses of the carrier cardboard. The multiple thickness tab is hinged to and pressed against a top or bottom wall of the carrier as the article is inserted into the carrier and, after article insertion, the tab springs into position within the open or chimed end of the article. Other latches include a panel that extends from an edge of a wall of the carrier and ends in a flap that is glued at the center of the carrier to provide an upstanding wall. One or more of the resulting oblique walls extending from the carrier wall edge to the center of a carrier has cut into it one or more openings, each for receiving a goblet foot or a closed end of a tumbler. The natural resilience of the cardboard from which the carriers are typically constructed allows insertion of the goblet foot or tumbler end into the opening under an appropriate urging force, but prevents easy withdrawal of the retained article end.

Typically, the latches for retaining a goblet foot or tumbler end prevent removal of an article without destroying the carrier. In manufacturing, this constraint generally requires destruction of a carrier that is incorrectly loaded or in which an article must be replaced. In addition, since a potential customer cannot easily withdraw the article to inspect it without damaging the carrier, some carriers are damaged on retail shelves and some customers are lost because of the inability to inspect the articles free of the carrier. In addition, the multiple thickness tabs used in known carriers are wasteful of carrier material. That is, multiple thickness tabs increase the expense of the carrier.

Accordingly, it is desirable to provide a carrier for articles in which articles could be freely inserted and withdrawn without damage to the carrier. In addition, it is desirable to provide such a carrier with a secure latch or retainer so that the withdrawable articles may be securely held within the carrier unless intentionally withdrawn. Moreover, it is desirable to have a carrier employing a single thickness tab for retaining an open or chimed end of an article that reliably and securely retains an article within the carrier.

SUMMARY OF THE INVENTION

A display carrier according to the invention includes conventional, opposed top and bottom and side walls hingedly connected together for form a sleeve. A novel deflectable retainer is provided along an outside edge of the bottom wall for releasably engaging an end of an article disposed in the carrier. The retainer is preferably formed of the same material as the carrier and is unitary with it. A preferred retainer is hinged along an outside edge of the bottom wall and is hingedly attached to the carrier bottom wall inside the carrier. The retainer is hingedly attached to the bottom wall between the center line of the bottom wall and the outside edge of the carrier at which the retainer is hinged. The retainer includes two additional hinges intermediate the outside edge of the bottom wall and the hinged attachment to the bottom wall. In cross section, the retainer forms a closed variable shape quadrilateral. By applying a force to the retainer in the direction of the bottom wall of the carrier, the retainer can be compressed for inserting or withdrawing an article. Upon release of the external force, the natural resilience of the retainer causes it to spring away from the bottom wall. Preferably, the retainer includes an opening having a shape complementary to the end of an article for engaging that article.

A carrier according to the invention includes a single ply tab for retaining an open or chimed end of an article within the carrier. The tab hingedly extends from an outside edge of the top wall of the carrier and includes a retaining portion for engaging the inside surface of the open or chimed end of an article. The retaining portion preferably includes an edge having a shape complementary to the inside surface of the article for secure engagement. The retaining tab also includes an attaching portion attached to the inside of the top wall of the carrier for holding the retaining portion in its operative position. The retaining and attaching portions of the tab are separated by an intermediate cut extending from the distal end of the tab to near the edge of the top wall at which the tab is hinged. The attaching portion preferably includes a flap defined by a hinge with the flap being adhered to the top wall of the carrier. A separating tab may descend from the flap for preventing direct contact, near the top wall, between the open ends of articles inserted within the carrier. Other separating tabs may be cut from the bottom wall and extend inwardly from that bottom wall for preventing direct contact, near the bottom wall, between the ends of articles inserted within the carrier.

Carriers according to the invention may accommodate one or more pairs of articles. In carriers intended to receive more than one pair of articles, it is preferred that a stabilizing and dividing wall, generally parallel to the side walls, extend between and be attached to the top and bottom walls to improve the strength of the carrier and to prevent direct contact between the pairs of articles inserted within the carrier.

DETAILED DESCRIPTION

Figure 1:
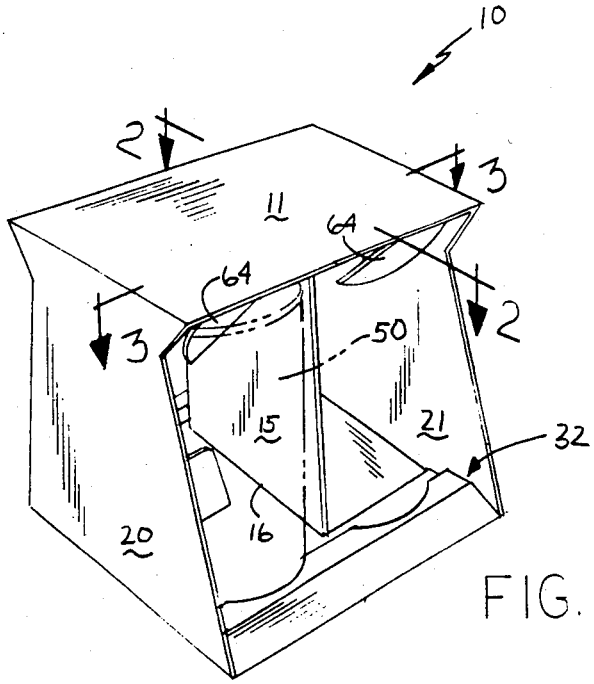
FIG. 1 is a perspective view of a carrier according to the invention showing in phantom lines article retained substantially within the carrier.

In all of the figures, like elements are given the same reference numbers. In FIGS. 1–4 a carrier 10 according to the invention is shown in various views. In FIG. 5, a blank 10′ from which carrier 10 may be assembled is shown in plan view with the inside surface of the carrier exposed. Areas of blank 10′ that are intended to be coated with an adhesive in the course of constructing carrier 10 from the blank are stippled. The exposed side of blank 10′ is referred to as the obverse side and the opposite side is referred to as the reverse side. The construction and operation of carrier 10 can best be understood by referring to FIGS. 1–5 together.

Carrier 10 includes a top wall 11 and an opposed bottom wall 12. In carrier 10, bottom wall 12 includes two half bottom wall portions 13 and 14. A divider wall panel 15, hingedly connected along a lateral fold line 16 to bottom wall portion 13, extends from bottom wall 12 to the inside of top wall 11. Lateral fold line 18 is transversely centrally located on bottom wall portion 13. Divider panel 15 includes an adhering flap 17 separated from divider panel 15 by a lateral fold line 18 for attachment to the inside of top wall 11. Lateral fold lines 16 and 18 may be at least partially cut through the paperboard from which carrier 10 is made in order to reduce the folding resistance along lines 16 and 18 during assembly of carrier 10.

In the preceding and following discussion, certain lines on blank 10′, such as fold lines 16 and 18, are referred to as lateral. These lines, and other lines generally parallel to them, and other features lying generally in the same direction, are referred to here as lateral. Lines and features generally perpendicular to the lateral direction, such as a transverse center line 19 of blank 10′, are referred to here as transverse. The reference to walls 11 and 12 as opposed top and bottom walls is made only for convenience and does not refer to any orientation of the carrier according to the invention. That is, these terms are only used for convenience of reference and could be interchanged. Likewise, while the invention is described below with respect to certain retaining structures extending from the top or bottom walls, the invention comprehends carriers having similar or different retainers extending from one or both of the top and bottom walls.

Figure 3:
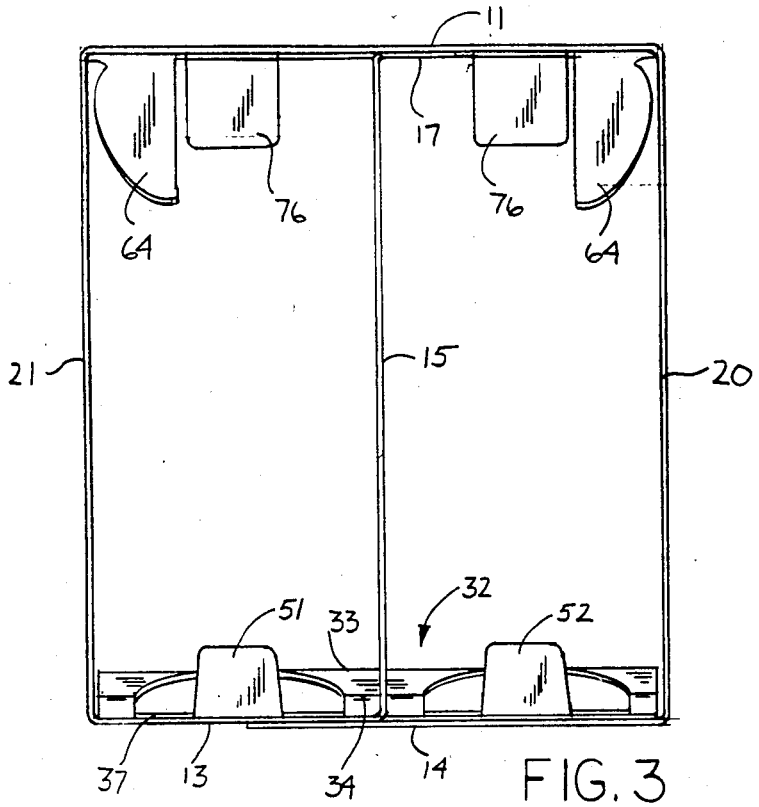
FIG. 3 is a sectional view taken along line 3—3 of FIG. 1 illustrating a carrier in accordance with the invention.

The construction of bottom wall 12 is best understood in reference to FIGS. 3 and 5. Because divider wall 15 is cut into and occupies part of bottom wall 12, it is necessary to provide bottom wall portions 13 and 14 to form a continuous bottom wall 12. To accomplish that end, portion 14 is adhered to the reverse side of portion 13 in the indicated stippled areas of portion 14. An adhesive is applied to portion 14 in the stippled areas so that parts of it that overlap portion 13 in the assembled carrier are glued together. The part of portion 14 that is free of adhesive supplies the part of bottom wall 12 that would otherwise be missing because of the presence of divider wall 15. Divider wall 15 not only supplies additional support and stability to carrier 10 because it extends between the top and bottom walls, but also prevents pairs of articles within carrier 10 from direct contact with each other. This protection is particularly important for fragile articles, such as glasses, that might collide within the carrier.

Opposing top and bottom walls 11 and 112 are joined by generally opposing side walls 20 and 21 so that the top and bottom and side walls form a sleeve. In blank 10′, side wall 20 is disposed between bottom wall portion 14 and top wall 11. Side wall 20 adjoins bottom wall portion 14 along a lateral fold line 22 and adjoins top wall 11 along a lateral fold line 23. Similarly, side wall 21 adjoins bottom wall portion 13 along a lateral fold line 24 and top wall 11 along a lateral fold line 25. These and other fold lines are used for folding blank 10′ during the construction of carrier 10. The resulting folds act as hinges so that the adjoining top, side and bottom walls are hingedly connected to each other as are various elements of the retainers described below. Thus carrier blank 10′ is a transverse continuous array of side, top and bottom wall panels separated by lateral fold lines. As described below, various retainer structures extend laterally from the top and bottom wall panels along transverse fold lines.

Carrier 10 includes separate and different retainers that extend from top wall 11 and bottom wall portion 13, respectively, for securely retaining articles inserted into carrier 10, yet allowing withdrawal of those articles in response to application of appropriate forces as described below. Turning first to the retainers extending from bottom wall portion 13, only one of those retainers is described since identical retaining structures extend from both of the opposed transverse fold lines 30 and 31 that define the transverse two edges of bottom wall portion 13.

A retainer 32 extends laterally from bottom wall portion 13 along a transverse fold line 30. Retainer 32 includes four generally transverse panels. Three of those panels are defined by adjacent pairs of transverse fold lines 30, 33, 34 and 35 and the fourth is defined by fold line 35 and a distal transverse edge 36. The panel between fold line 35 and edge 36 is an adhering flap 37. An adhesive is applied to flap 37 and it is adhered to the inside, obverse side of bottom wall portion 13. While for ease of understanding flap 37 is shown as stippled in FIG. 5, the adhesive is actually applied on the reverse side of flap 37, and not on the obverse side as shown in FIG. 5. Flap 37 is adhered to bottom wall 12 so that fold line 35 lies between center line 19 and fold line 30, a transverse edge of bottom wall 12.

Figure 2:
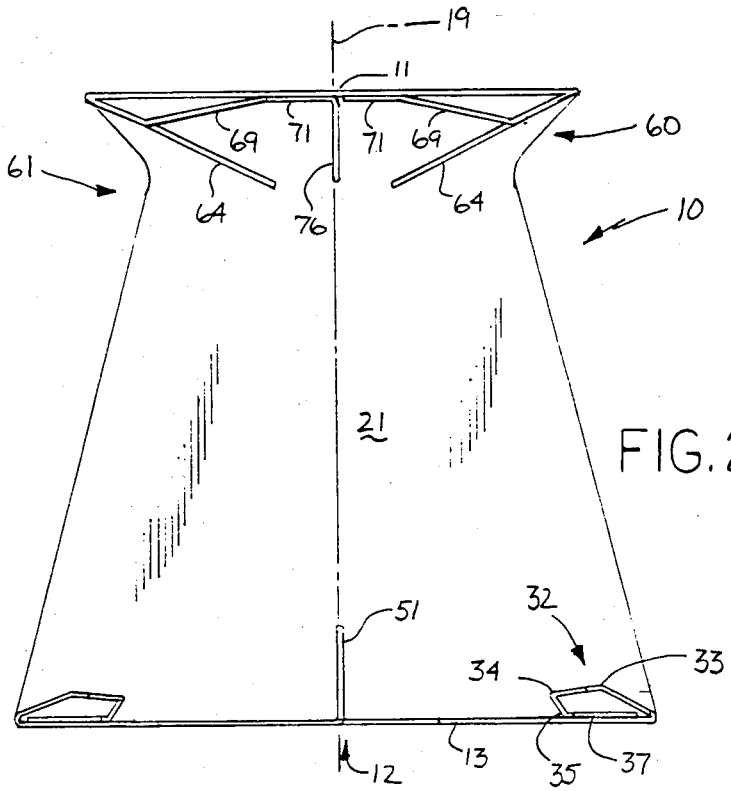
FIG. 2 is a sectional view taken along line 2—2 of FIG. 1 illustrating a carrier in accordance with the invention.
Figure 4:
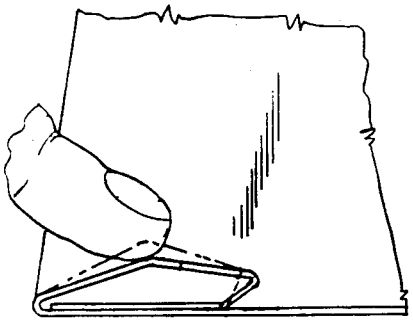
FIG. 4 shows a portion of one of the retainers of FIG. 2 further illustrating its operation.
Figure 5:
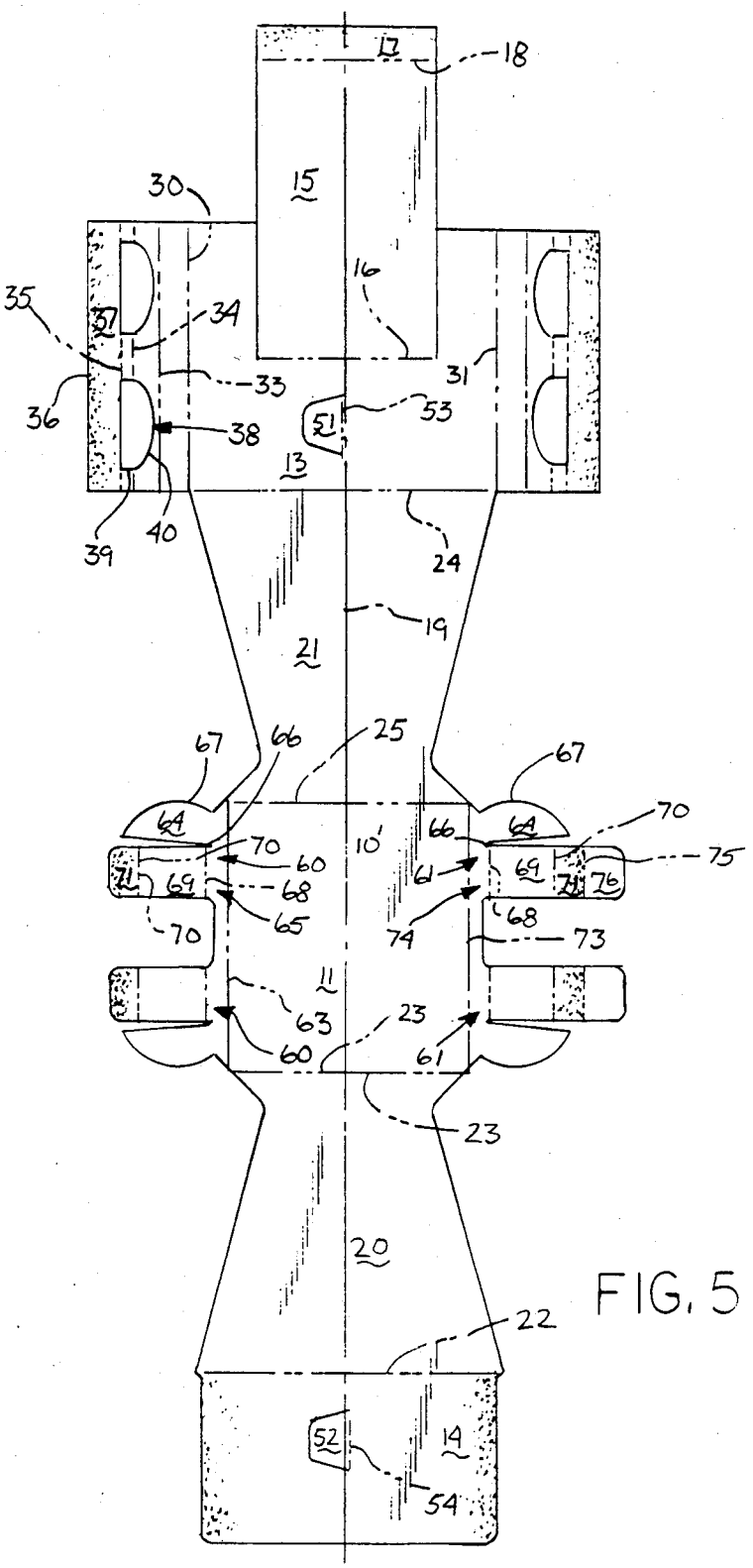
FIG. 5 is a plan view of a blank from which the carrier may be assembled.

In order to adhere flap 37 to bottom wall portion 13, retainer 32 is folded along each of fold lines 30, 33–35 so that, in cross section, a generally quadrilateral figure is described, as best seen in FIGS. 2 and 4. Generally, carriers of the type described are prepared from paperboard, light cardboard or similar resilient material that can be readily folded and that has a natural resilience. The natural resilience of material resists the folding sufficiently so that the quadrilateral shape shown is normally maintained unless an external force is applied to it. If, as shown in FIG. 4, a force is applied generally in the vicinity of fold line 33 toward bottom wall 12, retainer 32 may be temporarily deflected by virtue of the resilience of the paperboard and the presence of fold lines 33–35 acting as hinges. When the deflecting force is removed, the original shape of the retainer is restored by the resilience of the paperboard.

In order that the retainer may engage an article inserted within carrier 10, openings 38 are cut into retainer 32. Each of the openings 38 includes a generally rectangular portion 39 extending between fold lines 34 and 35 and a portion 40 having a curved margin shaped for complementary engagement of the outside surface of an article inserted within the carrier. As shown in FIG. 1, one type of article with which carriers are used are drinking glasses or tumblers 50. Opening 38, and particularly the curvature along the margin of opening portion 40, is cut to generally conform to the base of a tumbler, foot of a goblet, etc.

The operation of retainer 32 is apparent from FIGS. 1 and 4. In order to insert an article, such as a tumbler, into carrier 10, the foot of the tumbler is placed in contact with retainer 32 in the vicinity of fold line 33. In fact, the foot of the tumbler may bear on the generally transverse area between the fold lines 30 and 33. When the tumbler is urged toward the inside of carrier 10, retainer 32 is deflected downward towards bottom wall 12 allowing the foot of the tumbler to enter carrier 10. Once the tumbler end passes by fold line 33, the natural resiliency of retainer 32 causes it to regain its original position. In doing so, the curvature of opening portion 40 engages the foot of the tumbler, preventing its withdrawal from the carrier. In order to remove the tumbler, retainer 32 is deflected towards bottom wall 12 by an externally applied force, as indicated in FIG. 4. Upon sufficient deflection of retainer 32, the foot of a tumbler can be withdrawn from the carrier. When the external force is removed, retainer 32 springs back to its original position. As is apparent from FIGS. 1, 3, 4 and 5, retainer 32 is spaced from and does not interact with side walls 20 and 21 in the insertion of articles into, and withdrawal of articles from, the carrier.

In order to prevent collisions between ends of articles inserted within carrier 10, separating flaps 51 and 52 extend upwardly from bottom wall 12 within carrier 10. Flaps 51 and 52 are cut from bottom wall panels 13 and 14, respectively, by cut lines that define their margins and by transverse fold lines 53 and 54, respectively. Fold lines 53 and 54 generally lie along transverse center line 19 on their respective panels so that flaps 51 and 52 are centered within carrier 10 to accommodate identical articles within the carrier.

Carrier 10 employs a pair of retainers 60 and 61, having slightly different structures, extending from the transverse edges of top wall 11. Because each retainer in each pair is identical, only one retainer in each pair is described in detail. These retainers 60 and 61 are intended for use with an article having an open end, such as a tumbler, or an article having a chimed end, such as a beverage can.

The left transverse edge of top wall 11, as viewed in FIG. 5, is defined by a transverse fold line 63. Retainer 60 extends laterally from fold line 63. Each retainer 60 includes a retaining portion 64 and an attaching portion 65. Retaining portion 64 and attaching portion 65 are separated by a generally lateral slot or cut 66. Retaining portion 64 lines transversely outward from attaching portion 65. Along its transversely outward margin, attaching portion 64 includes a curved edge 67 for complementary engagement of an inside surface of a tumbler, beverage can or like article.

Near the proximate end of cut 66, i.e., where cut 66 is closest to transverse fold line 63, a transverse fold line 68 is formed in attaching portion 65. A generally transverse flap 69 is defined by fold line 68 and a second transverse fold line 70. Lying outwardly from fold line 70 is a distal flap 71. As indicated in FIG. 5, distal flap 71 provides an adhering surface for attachment to the inside of top wall 11 and receives an adhesive on its obverse side.

In the structure of retainer 60, it is notable that transverse fold line 68 does not extend to retaining portion 64. In an assembled carrier, retainers 60 are folded about fold line 63. A partial fold is made around fold line 68 in the same direction and a slight reverse fold is made along fold line 70 so that distal flap 71 may be adhered to the inside of top wall 11 near transverse center line 19. Because of the fold along fold line 68, retaining portion 64, by the natural resilience of the material from which carrier 10 is formed, diverges from the inside surface of top wall 11. That is, attaching portion 65, by virtue of the limited length of fold line 68 and the attachment of flap 71 to the inside of top wall 11, holds retaining portion 64 in an operative position relative to top wall 11. As an article is being inserted into carrier 10, retaining portion 64 is deflected along the hinge of fold line 63 toward top wall 11 by the edge of the article. When the article reaches its seated or engaged position within carrier 10, retaining portion 64, under the influence of the natural resilience of the material from which carrier 10 is formed, pivots away from top wall 11. Retaining portion 64 descends into the open or chimed end of the article, securely retaining the article within the carrier 10.

Retaining portion 64 is made of a single ply of paperboard or cardboard, rather than the multiple plies used in previously known retaining flaps. Instead of using extra plies to ensure that the flaps securely engage an open or chimed end of an article, in the novel structure the attaching portion applies a force to the retaining portion urging it into an open or chimed end of an article. This force and the complementary engagement of edge 67 with the inside surface of the article end cooperate to retain articles securely.

The structure of retainer 61 is substantially similar to that of retainer 60. Therefore, like elements are given the same reference numerals and are not further described to the extent they are similar to the elements of retainer 60. Retainer 61 extends laterally from transverse fold line 73 that defines the right transverse edge of top wall 11 as viewed in FIG. 5. Retainer 61 is generally similar to retainer 60 except for an added distal tab on an attaching portion 74 that generally corresponds to attaching portion 65 of retainer 60. Attaching portion 74 includes a transverse fold line 75 lying outwardly from attaching flap 71, defining a distal tab 76. As noted above, flap 71 is adhered near transverse center line 19 of top wall 11. Tab 76 is folded in assembled carrier 10 along fold line 75 so that tab 76 descends from top wall 11 toward the inside of carrier 10 approximately along transverse center line 19. Distal tab 76 separates, adjacent top wall 11, the ends of a pair of articles inserted in carrier 10 and prevents their direct contact. When the articles are fragile, such as glass tumblers, this separator provides additional protection against breakage. Generally, a tab 76 is disposed in carrier 10 opposite each of flaps 51 and 52 so that both ends of pairs of articles inserted in carrier 10 are prevented from directly contacting along lateral directions. Separator panel 15 provides protection against direct contact of articles in carrier 10 along transverse directions.

Carrier 10 as shown and described is intended for use with two pairs of articles, each article having one opened or chimed end and an opposite end that may be closed or may also be open or chimed. Variants of carrier 10 might include retainers 32 adjacent both the top and bottom walls of the carrier. Likewise, if the articles to be retained have opposed opened or chimed ends of some combination of them, retainers 60 and 61 may be disposed adjacent both the top and bottom walls of a carrier. Moreover, carriers for retaining more than two pairs of articles can readily be constructed applying the principles of the invention described above.

Figure 6:
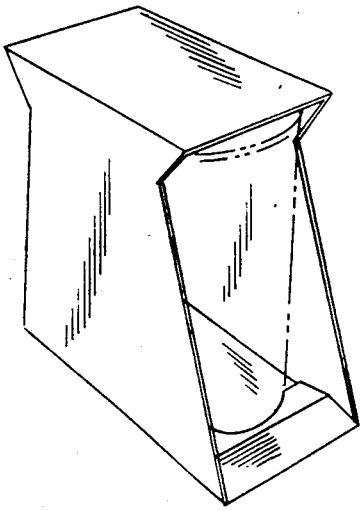
FIG. 6 is a perspective view of another carrier according to the invention showing in phantom lines an article retained substantially within the carrier.
Figure 7:
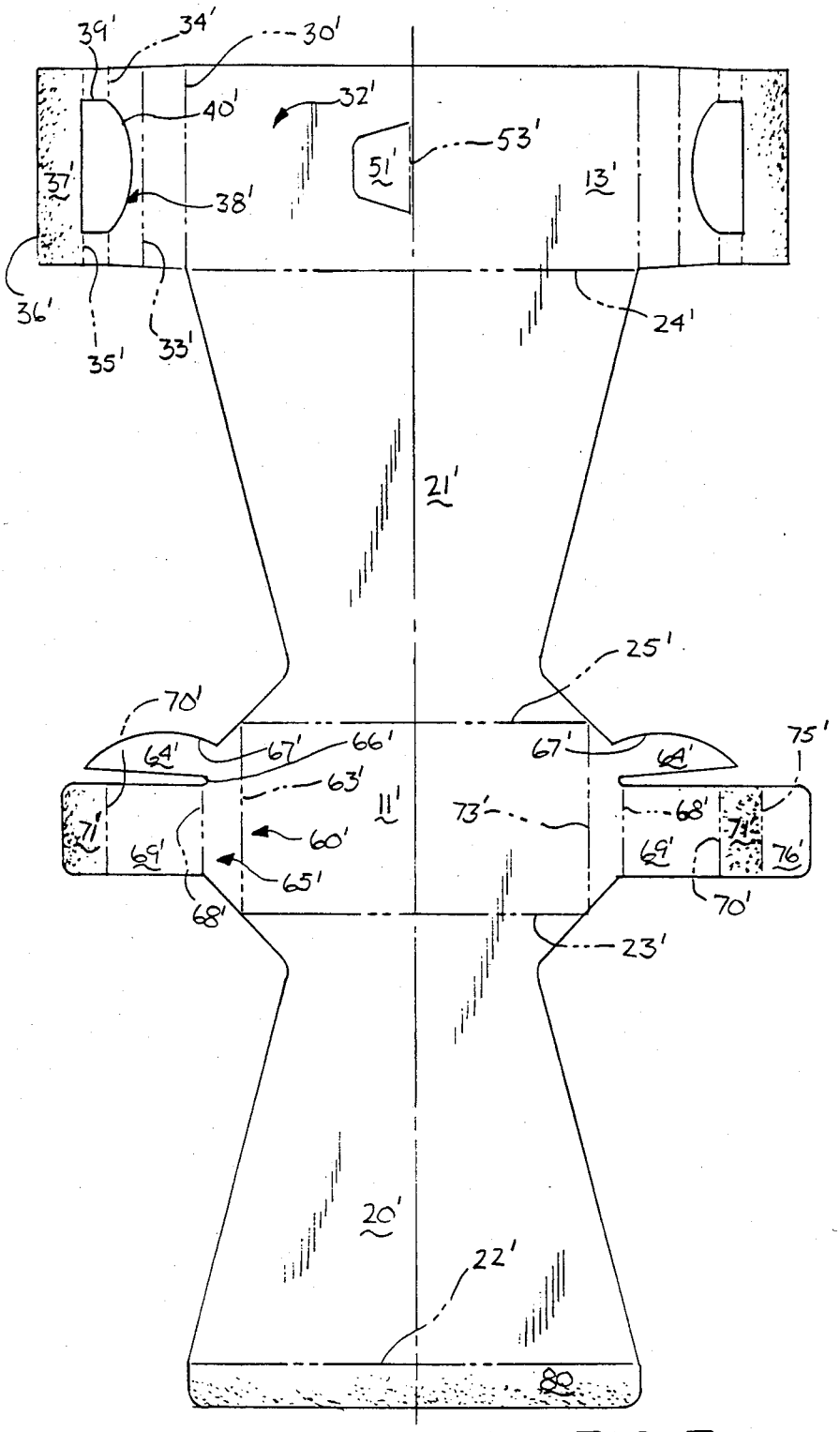
FIG. 7 is a plan view of a blank from which the carrier of FIG. 6 may be assembled.

In FIGS. 6 and 7, a carrier according to the invention for retaining only a single pair of articles is illustrated. In FIG. 6, a carrier 100 is shown in a perspective view. In FIG. 7, the inside surface of a blank 100' for assembling carrier 100 is shown. Elements of carrier 100 and of a blank 100' corresponding to elements of carrier 10 and blank 10', respectively, are given the same reference numerals in FIGS. 6 and 7 as in FIGS. 1 and 5, but with an added prime. As can be seen from a comparison of FIGS. 1 and 5 to FIGS. 6 and 7, respectively, carrier 100 and blank 100' contain nearly all of the elements of carrier 10 and blank 10'. Carrier 100 and blank 100' lack separator wall 15 and adhering flap 17. As a result, the structure of bottom wall 12' is substantially simplified. Adjoining side wall 20' along lateral fold line 22', is an adhering flap 80 for receiving an adhesive on its obverse side. Flap 80 is adhered to the outside of bottom wall panel 13' to close the sleeve formed by opposing side walls 20' and 21' and opposing top and bottom walls 11' and 12'. With this structure, blank 100' has no need for and lacks bottom wall portion 14 of FIG. 5. The structure of retainer 32' is identical to that of retainer 32, except that each retainer includes only a single opening 38'. The structures of retainers 60' and 61' are identical to those of 60 and 61, respectively.

The assembly of carriers 10 and 100 from blanks 10' and 100' is completed by conventional means. The blanks and the openings within them are cut from paperboard stock. Fold lines and any partially cut fold lines may be formed at the same time. An adhesive is then applied to the adhering flaps identified in the foregoing descriptions. Thereafter, the necessary folds are made in the blanks to attach the adhering flaps to the desired locations to complete the carrier assembly. Most or all of these steps can be performed by automatic machinery.

The invention has been described with respect to certain preferred embodiments. Various additions and modifications within the spirit of the invention will occur to those of skill in the art. Accordingly, the scope of the invention is limited solely by the following claims.

I claim:

1. A display carrier for articles, the carrier comprising:

opposing top and bottom walls having opposing pairs of transverse and lateral edges, said top and bottom walls each having a center line generally equidistantly spaced between their respective transverse edges;

opposing side walls hingedly attached to said lateral edges of said top and bottom walls to form a sleeve; and retaining means for releasably engaging an end of an article in said carrier, said retaining means having a hinged extension including deflection means hingedly extending from at least one transverse edge of said bottom wall, transversely hingedly attached to said bottom wall inside said carrier at a location between said bottom wall center line and the transverse edge at which said retaining means is hinged, and two generally transverse hinges disposed between said hinged extension and hinged attachment for deflection of said retaining means toward said bottom wall for: (i) withdrawing an article from said carrier; and (ii) inserting an article into said carrier.

2. The carrier of claim 1 wherein said retaining means extends between and is spaced from said side walls.

3. The carrier of claim 1 wherein said retaining means includes a distal flap adhered to said bottom wall.

4. The carrier of claim 1 wherein said retaining means includes at least one opening for receiving and engaging an end of an article disposed in said carrier.

5. The carrier of claim 1 including a dividing wall, disposed generally parallel to said side walls, extending from one of said top and bottom walls and attached to the other of said top and bottom walls, for preventing one pair of articles in said carrier from directly contacting another pair of articles in said carrier.

6. The carrier of claim 1 including a separating tab cut from said bottom wall, hingedly attached to said bottom wall generally along said bottom wall center line and extending inwardly from said bottom wall for preventing ends of at least two articles disposed in said carrier from directly touching.

7. The carrier of claim 1 including second retaining means for engaging an end of an article disposed in said carrier, said second retaining means hingedly extending from at least one of said transverse edges of said top wall and comprising a retaining portion for engaging the inside surface of an open or chimed end of an article and an attaching portion attached to said top wall inside said carrier for holding said retaining portion in an operative position proximate said top wall.

8. The carrier of claim 7 wherein said retaining portion and said attaching portion are separated by a generally lateral cut disposed between them, but not extending to the transverse edge of said top wall from which said second retaining means extends.

9. The carrier of claim 7 wherein said attaching portion includes a transverse hinge proximate said transverse edge from which said second retaining means extends.

10. The carrier of claim 9 wherein said attaching portion includes a distal flap defined by a second transverse hinge, said flap being adhered to said top wall inside said carrier.

11. The carrier of claim 10 wherein said attaching means includes a tab extending from said distal flap proximate a third transverse hinge separating said flap and said tab, said third transverse hinge being disposed generally along said top wall center line and said tab extending inwardly from said top wall for preventing ends of at least two articles disposed in said carrier from directly contacting.

12. A display carrier for articles, the carrier comprising a bottom wall with a generally straight free edge and side walls extending up from the bottom wall adjacent to the free edge to surround the article to be carried, and retaining means for releasably securing an article in the carrier, the retaining means being shiftable between article-retaining and article-releasing positions when the article is in the carrier and including a retaining panel hingedly connected to the free edge of the bottom wall and foldable in a first direction about the hinged connection from a generally upright, article-retaining position to a flattened position in which the retaining panel is superimposed on the bottom wall to permit removal of the article from the carrier, and limiting means for preventing folding motion of the retaining panel about the hinged connection from the article-retaining position in a direction opposite from the first direction.

13. The carrier of claim 12 wherein the limiting means includes a pair of limit panels hinged to each other and one limit panel having an edge portion hinged to the retaining panel and the second limit panel being hinged to the bottom wall, the limit panels being generally coplanar when the retaining panel is in the article-retaining position.

14. The carrier of claim 13 wherein the limit panels include an opening for engaging an end of an article inserted in the carrier.

15. A display carrier for articles, the carrier comprising:

opposing top and bottom walls having opposing pairs of transverse and lateral edges, said top and bottom walls each having a center line generally equidistantly spaced between their respective transverse edges;

opposing side walls hingedly attached to said lateral edges of said top and bottom walls to form a sleeve; and retaining means for engaging an end of an article disposed in said carrier, said retaining means comprising a panel having proximal and distal edges, the proximal edge being hingedly connected to a transverse edge of said top wall, a lateral cut extending from the distal edge of the panel toward the proximal edge of the panel and dividing the panel into a retaining portion and an attaching portion, a transverse hinge across said retaining portion located between the distal edge of the panel and the proximal end of the lateral cut, and means for securing the distal end portion of the attaching portion of the panel to said top wall with said transverse hinge spaced away from said top wall.

16. A blank for forming a display carrier for articles, the blank comprising:

a transverse, continuous array of panels joined along lateral fold lines and having a transverse center line including: a bottom wall panel joined along a first lateral fold line to a first side wall panel, said first side wall panel being joined along a second lateral fold line to a top wall panel, said top wall panel being joined along a third lateral fold line to a second side wall panel;

first retaining means panel extending laterally from said bottom wall panel along a first transverse fold line, said first retaining means panel including spaced apart second, third and fourth transverse fold lines, and a flap outwardly disposed from said fourth transverse fold line for attaching to said bottom wall so that said fourth transverse fold line is disposed on said bottom wall between said first transverse fold line and said center line in a carrier from said blank, said retaining means panel including an opening for engaging an end of an article in a carrier formed from said blank, said opening having an edge disposed substantially along said fourth transverse fold line; and a second retaining means panel extending laterally from said top wall panel along a fifth transverse fold line, said second retaining means panel including a retaining portion for engaging the inside surface of an open or chimed end of an article inserted into a carrier formed from said blank and an attaching portion for attachment to said top wall panel in a carrier formed from said blank for holding said retaining means in an operative position relative to said top wall panel, said retaining portion and attaching portion being separated by a generally lateral cut disposed between said retaining and attaching portions, but not extending to said fifth transverse fold line.

17. A blank for forming a display carrier for articles, the blank comprising:

a transverse, continuous array of panels joined along lateral fold lines and having a transverse center line including: a bottom wall panel joined along a first lateral fold line to a first side wall panel, said first side wall panel being joined along a second lateral fold line to a top wall panel, said top wall panel being joined along a third lateral fold line to a second side wall panel;

a retaining means panel extending laterally from said top wall panel along a first transverse fold line, said retaining means panel including a retaining portion for engaging the inside surface of an open or chimed end of an article inserted into a carrier formed from said blank and an attaching portion for attachment to said top wall panel in a carrier formed from said blank for holding said retaining means in an operative position relative to said top wall panel, said retaining portion and attaching portion being separated by a generally lateral cut disposed between said retaining and attaching portions, but not extending to said first transverse fold line, said attaching portion including a second transverse fold line proximate the end of said cut nearest said first transverse fold line, and a third transverse fold line, said third transverse fold line defining an adhering flap lying outwardly from said third transverse fold line, and a fourth transverse fold line disposed outwardly from said third transverse fold line to define a tab for preventing direct contact between the ends of articles inserted in a carrier formed from the blank.

18. The blank of claim 17 including a second retaining means panel extending laterally from said bottom wall panel along a fifth transverse fold line, said second retaining means panel including spaced apart sixth, seventh and eighth transverse fold lines, and a flap outwardly disposed from said eighth transverse fold line for attaching to said bottom wall so that said eighth transverse fold line is disposed on said bottom wall between said fifth transverse fold line and said center line in a carrier formed from said blank.

19. The carrier of claim 15 wherein said attaching portion includes a distal flap defined by a second transverse hinge, said flap being adhered to said top wall inside said carrier.

20. The carrier of claim 19 wherein said attaching means includes a tab extending from said distal flap proximate a third transverse hinge separating said flap and said tab, said third transverse hinge being disposed generally along said top wall center line and said tab extending inwardly from said top wall for preventing ends of at least two articles disposed in said carrier from directly contacting.

21. The carrier of claim 15 including second retaining means for releasably engaging an end of an article in said carrier, said second retaining means including deflection means hingedly extending from at least one transverse edge of said bottom wall, transversely hingedly attached to said bottom wall inside said carrier at a location between said bottom wall center line and the transverse edge at which said second retaining means is hinged, and two generally transverse hinges disposed between said hinged extension and hinged attachment for deflection of said second retaining means toward said bottom wall for: (i) withdrawing an article from said carrier; and (ii) inserting an article into said carrier.

22. The carrier of claim 21 wherein said second retaining means extends between and is spaced from said side walls.

23. The blank of claim 16 wherein said attaching portion includes a sixth transverse fold line proximate the end of said cut nearest said fifth transverse fold line, and an seventh transverse fold line, said seventh transverse fold line defining an adhering flap lying outwardly from said seventh transverse fold line.

24. The blank of claim 23 wherein said attaching portion includes a eighth transverse fold line disposed outwardly from said seventh transverse fold line to define a tab for preventing direct contact between the ends of articles inserted in a carrier formed from the blank.

25. The blank of claim 16 including an adhering flap extending transversely from said second side wall panel along a fourth lateral fold line.

26. The blank of claim 16 including a bottom wall panel portion extending transversely from said second side wall panel along a fourth lateral fold line.

27. The blank of claim 26 including a support wall panel transversely extending from said bottom wall panel portion along a fifth lateral fold line disposed generally transversely centrally on said bottom wall panel portion.

* * * * *